US009966012B2

(12) United States Patent
Hoshino

(10) Patent No.: US 9,966,012 B2
(45) Date of Patent: May 8, 2018

(54) IMAGE DISPLAY APPARATUS AND CONTROL METHOD THEREOF

(71) Applicant: CANON KABUSHIKI KAISHA, Tokyo (JP)

(72) Inventor: Hironobu Hoshino, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 14/952,145

(22) Filed: Nov. 25, 2015

(65) Prior Publication Data

US 2016/0155402 A1 Jun. 2, 2016

(30) Foreign Application Priority Data

Dec. 1, 2014 (JP) ..... 2014-243300
Nov. 12, 2015 (JP) ..... 2015-222249

(51) Int. Cl.
*G09G 3/34* (2006.01)
*G09G 3/36* (2006.01)
*G09G 3/20* (2006.01)

(52) U.S. Cl.
CPC ..... *G09G 3/3406* (2013.01); *G09G 3/3426* (2013.01); *G09G 3/3611* (2013.01); *G09G 3/2011* (2013.01); *G09G 2300/023* (2013.01); *G09G 2330/021* (2013.01); *G09G 2360/16* (2013.01)

(58) Field of Classification Search
CPC combination set(s) only.
See application file for complete search history.

(56) References Cited

U.S. PATENT DOCUMENTS

2007/0216311 A1* 9/2007 Cernasov ..... G09G 3/3426 315/3
2011/0304597 A1* 12/2011 Hyatt ..... G09G 3/3426 345/207
2014/0285511 A1 9/2014 Hoshino
2015/0187283 A1* 7/2015 Jiang ..... G09G 3/3426 345/690

FOREIGN PATENT DOCUMENTS

JP 2008122536 A 5/2008
JP 2010107535 A 5/2010

* cited by examiner

*Primary Examiner* — Robin Mishler
(74) *Attorney, Agent, or Firm* — Fitzpatrick, Cella, Harper & Scinto

(57) ABSTRACT

An image display apparatus according to the present invention, includes a light emitter, a first panel configured to transmit light emitted from the light emitter, a second panel configured to transmit light transmitted through the first panel, and a controller configured to control emission brightness of the light emitter and at least one of transmittance of the first panel and transmittance of the second panel, based on input image data.

12 Claims, 14 Drawing Sheets

FIG. 5A

| | | | | |
|---|---|---|---|---|
| 401 | 402 | 403 | 404 | 405 |
| 406 | 407 | 408 | 409 | 410 |
| 411 | 412 | 413 | 414 | 415 |
| 416 | 417 | 418 | 419 | 420 |
| 421 | 422 | 423 | 424 | 425 |

FIG. 5B

| | | | | |
|---|---|---|---|---|
| 50% | 50% | 50% | 50% | 50% |
| 50% | 50% | 50% | 50% | 50% |
| 50% | 50% | 50% | 50% | 50% |
| 50% | 50% | 50% | 50% | 50% |
| 50% | 50% | 50% | 50% | 50% |

FIG. 5C

| | | | | |
|---|---|---|---|---|
| 1% | 1% | 1% | 1% | 1% |
| 1% | 1% | 1% | 1% | 1% |
| 1% | 1% | 1% | 1% | 1% |
| 1% | 1% | 1% | 1% | 1% |
| 1% | 1% | 1% | 1% | 1% |

FIG. 5D

| | | | | |
|---|---|---|---|---|
| 50% | 50% | 50% | 50% | 50% |
| 50% | 50% | 50% | 50% | 50% |
| 50% | 50% | 100% | 50% | 50% |
| 50% | 50% | 50% | 50% | 50% |
| 50% | 50% | 50% | 50% | 50% |

FIG. 6A

| | EMISSION BRIGHTNESS 0% (OFF STATE) | EMISSION BRIGHTNESS 1% | EMISSION BRIGHTNESS 4% | EMISSION BRIGHTNESS 50% | EMISSION BRIGHTNESS 100% |
|---|---|---|---|---|---|
| POWER CONSUMPTION OF BACKLIGHT UNIT | 0W | 0.5W | 2W | 25W | 50W |

FIG. 6B

| | TRANSMITTANCE 0% | TRANSMITTANCE 1% | TRANSMITTANCE 20% | TRANSMITTANCE 50% | TRANSMITTANCE 100% |
|---|---|---|---|---|---|
| POWER CONSUMPTION OF FIRST LIQUID CRYSTAL PANEL | 5W | 5.05W | 6W | 7.5W | 10W |
| POWER CONSUMPTION OF SECOND LIQUID CRYSTAL PANEL | 5W | 5.05W | 6W | 7.5W | 10W |

FIG. 11A
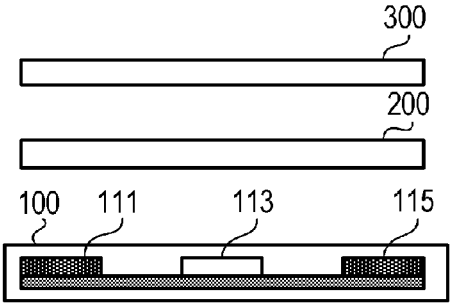
FIG. 11B
| | | | | |
|---|---|---|---|---|
| 5% | 10% | 20% | 10% | 5% |
| 10% | 30% | 60% | 30% | 10% |
| 20% | 60% | 100 % | 60% | 20% |
| 10% | 30% | 60% | 30% | 10% |
| 5% | 10% | 20% | 10% | 5% |
FIG. 11C
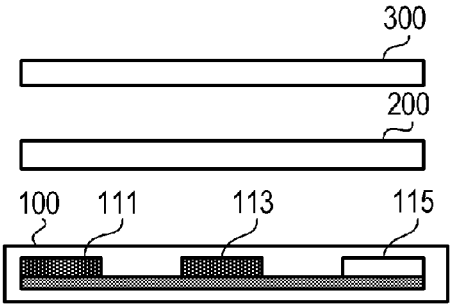
FIG. 11D
| | | | | |
|---|---|---|---|---|
| 0% | 0% | 5% | 10% | 20% |
| 0% | 5% | 10% | 30% | 60% |
| 0% | 5% | 20% | 60% | 100 % |
| 0% | 5% | 10% | 30% | 60% |
| 0% | 0% | 5% | 10% | 20% |
FIG. 11E
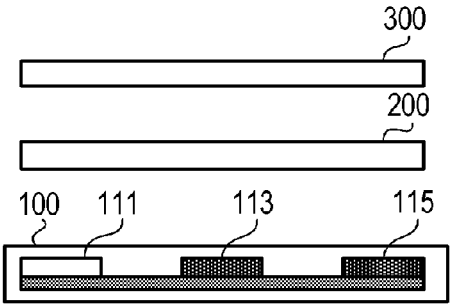
FIG. 11F
| | | | | |
|---|---|---|---|---|
| 20% | 10% | 5% | 0% | 0% |
| 60% | 30% | 10% | 5% | 0% |
| 100 % | 60% | 20% | 5% | 0% |
| 60% | 30% | 10% | 5% | 0% |
| 20% | 10% | 5% | 0% | 0% |

FIG. 12A

| | | | | |
|---|---|---|---|---|
| 0% | 0% | 0% | 0% | 0% |
| 0% | 0% | 0% | 0% | 0% |
| 0% | 0% | 100% | 15% | 0% |
| 0% | 0% | 0% | 0% | 0% |
| 0% | 0% | 0% | 0% | 0% |

FIG. 12B

| | | | | |
|---|---|---|---|---|
| 0% | 0% | 0% | 0% | 0% |
| 0% | 0% | 0% | 0% | 0% |
| 0% | 0% | 50% | 50% | 0% |
| 0% | 0% | 0% | 0% | 0% |
| 0% | 0% | 0% | 0% | 0% |

FIG.13A

| | | | | |
|---|---|---|---|---|
| 0% | 0% | 0% | 0% | 0% |
| 0% | 0% | 0% | 0% | 0% |
| 0% | 0% | 100% | 0% | 0% |
| 0% | 0% | 0% | 0% | 0% |
| 0% | 0% | 0% | 0% | 0% |

DISPLAY TARGET IMAGE DATA

FIG. 13B

| | | | | |
|---|---|---|---|---|
| 0% | 0% | 0% | 0% | 0% |
| 0% | 0% | 0% | 0% | 0% |
| 0% | 0% | 100% | 0% | 0% |
| 0% | 0% | 0% | 0% | 0% |
| 0% | 0% | 0% | 0% | 0% |

FIRST LIQUID CRYSTAL PANEL

| | | | | |
|---|---|---|---|---|
| 0% | 0% | 0% | 0% | 0% |
| 0% | 0% | 0% | 0% | 0% |
| 0% | 0% | 100% | 0% | 0% |
| 0% | 0% | 0% | 0% | 0% |
| 0% | 0% | 0% | 0% | 0% |

SECOND LIQUID CRYSTAL PANEL

| | | | | |
|---|---|---|---|---|
| 100% | 100% | 100% | 100% | 100% |
| 100% | 100% | 100% | 100% | 100% |
| 100% | 100% | 100% | 100% | 100% |
| 100% | 100% | 100% | 100% | 100% |
| 100% | 100% | 100% | 100% | 100% |

BACKLIGHT UNIT

| | | | | |
|---|---|---|---|---|
| 0% | 0% | 0% | 0% | 0% |
| 0% | 0% | 0% | 0% | 0% |
| 0% | 0% | 100% | 0% | 0% |
| 0% | 0% | 0% | 0% | 0% |
| 0% | 0% | 0% | 0% | 0% |

DISPLAY IMAGE

FIG. 13C

FIRST LIQUID CRYSTAL PANEL

| | | | | |
|---|---|---|---|---|
| 100% | 100% | 100% | 100% | 100% |
| 100% | 100% | 100% | 100% | 100% |
| 100% | 100% | 100% | 100% | 100% |
| 100% | 100% | 100% | 100% | 100% |
| 100% | 100% | 100% | 100% | 100% |

SECOND LIQUID CRYSTAL PANEL

| | | | | |
|---|---|---|---|---|
| 100% | 100% | 100% | 100% | 100% |
| 100% | 100% | 100% | 100% | 100% |
| 100% | 100% | 100% | 100% | 100% |
| 100% | 100% | 100% | 100% | 100% |
| 100% | 100% | 100% | 100% | 100% |

BACKLIGHT UNIT

| | | | | |
|---|---|---|---|---|
| 0% | 0% | 0% | 0% | 0% |
| 0% | 0% | 0% | 0% | 0% |
| 0% | 0% | 100% | 0% | 0% |
| 0% | 0% | 0% | 0% | 0% |
| 0% | 0% | 0% | 0% | 0% |

DISPLAY IMAGE

| | | | | |
|---|---|---|---|---|
| 0% | 0% | 0% | 0% | 0% |
| 0% | 0% | 0% | 0% | 0% |
| 0% | 0% | 100% | 0% | 0% |
| 0% | 0% | 0% | 0% | 0% |
| 0% | 0% | 0% | 0% | 0% |

IMAGE DISPLAY APPARATUS AND CONTROL METHOD THEREOF

BACKGROUND OF THE INVENTION

Field of the Invention

The present invention relates to an image display apparatus and a control method thereof.

Description of the Related Art

Recently improvements in the visibility of display images (images displayed on a screen) are demanded for image display apparatuses. Specifically, an increase in the ratio between the bright part and the dark part (contrast ratio) of display images is demanded for image display apparatuses.

A prior art on the image display apparatus is disclosed, for example, in Japanese Patent Application Laid-Open No. 2010-107535 and Japanese Patent Application Laid-Open No. 2008-122536.

Japanese Patent Application Laid-Open No. 2010-107535 discloses a liquid crystal display apparatus having a liquid crystal panel and a backlight unit. In the liquid crystal display apparatus disclosed in Japanese Patent Application Laid-Open No. 2010-107535, the transmittance of the liquid crystal panel in the bright part display region and the emission brightness of the backlight unit in the bright part display region are increased. Further, the transmittance of the liquid crystal panel in the dark part display region and the emission brightness of the backlight unit in the dark part display region are decreased. The bright part display region is a region where bright parts of the image are displayed, out of the regions on the screen, and the dark part display region is a region where dark parts of the image are displayed, out of the regions on the screen. A control to partially change the emission brightness of the backlight unit is called "local dimming control".

However, the minimum size of a region where the emission brightness can be changed by the local dimming control is larger than the size of the liquid crystal element of the liquid crystal panel. Therefore, if an image having many high frequency components (e.g. an image having many fine edges) is displayed, the contrast ratio of the display image is not improved very much even if the local dimming control is performed.

Japanese Patent Application Laid-Open No. 2008-122536 discloses a liquid crystal display apparatus having a color liquid crystal panel, a monochrome liquid crystal panel, and a backlight unit. The backlight unit emits light at a predetermined emission brightness. The monochrome liquid crystal panel is disposed between the color liquid crystal panel and the backlight unit, and the light emitted from the backlight unit transmits through the monochrome liquid crystal panel, and then transmits through the color liquid crystal panel. In the liquid crystal display apparatus disclosed in Japanese Patent Application Laid-Open No. 2008-122536, not only the transmittance of the color liquid crystal panel, but also the transmittance of the monochrome liquid crystal panel is controlled. Thereby the contrast ratio of the display images improves. Such a structure of having the two liquid crystal panels is hereafter called "double panel structure".

The minimal size of the region where the transmittance of the monochrome liquid crystal panel can be changed is the size of the liquid crystal element of the monochrome liquid crystal panel, and is smaller than the minimal size of the region where the emission brightness can be changed by the local dimming control. Therefore in the image display apparatus having the double panel structure, the contrast ratio of the display image can be easily improved, even if the display image includes many high frequency components.

However, in the case of a conventional liquid crystal display apparatus having the double panel structure, the emission brightness of the backlight unit is controlled to a higher value than the case of using one liquid crystal panel considering that the light emitted from the backlight unit transmits through the two liquid crystal panels. As a result, in the conventional liquid crystal display apparatus, total power consumption of the liquid crystal apparatus is increased by the use of the double panel structure.

SUMMARY OF THE INVENTION

The present invention provides a technique to reduce the total power consumption of an image display apparatus having the double panel structure.

The present invention in its first aspect provides an image display apparatus, comprising:

a light emitter;

a first panel configured to transmit light emitted from the light emitter;

a second panel configured to transmit light transmitted through the first panel; and a controller configured to control emission brightness of the light emitter and at least one of transmittance of the first panel and transmittance of the second panel, based on input image data.

The present invention in its second aspect provides a method for controlling an image display apparatus having:

a light emitter;

a first panel configured to transmit light emitted from the light emitter; and a second panel configured to transmit light transmitted through the first panel, the method comprising:

acquiring input image data; and controlling emission brightness of the light emitter and at least one of transmittance of the first panel and transmittance of the second panel, based on the input image data.

The present invention in its third aspect provides a non-transitory computer readable medium that stores a program, wherein the program causes a computer to execute a method for controlling an image display apparatus having:

a light emitter;

a first panel configured to transmit light emitted from the light emitter; and a second panel configured to transmit light transmitted through the first panel, the method comprising:

acquiring input image data; and controlling emission brightness of the light emitter and at least one of transmittance of the first panel and transmittance of the second panel, based on the input image data.

According to the present invention, the total power consumption of an image display apparatus having the double panel structure can be reduced.

Further features of the present invention will become apparent from the following description of exemplary embodiments with reference to the attached drawings.

BRIEF DESCRIPTION OF THE DRAWINGS

FIG. 5A to FIG. 5D show examples of a display target image according to Embodiment 1;

FIG. 6A and FIG. 6B show examples of power information according to Embodiments 1 and 2;

FIG. 11A to FIG. 11F are diagrams for explaining an example of the emission profile according to Embodiment 2;

FIG. 12A and FIG. 12B show examples of a display target image according to Embodiment 2; and FIG. 13A to FIG. 13C are diagrams for explaining an example of an effect according to another example.

DESCRIPTION OF THE EMBODIMENTS

Embodiment 1

An image display apparatus according to Embodiment 1 of the present invention and a control method thereof will now be described.

Figure 1:
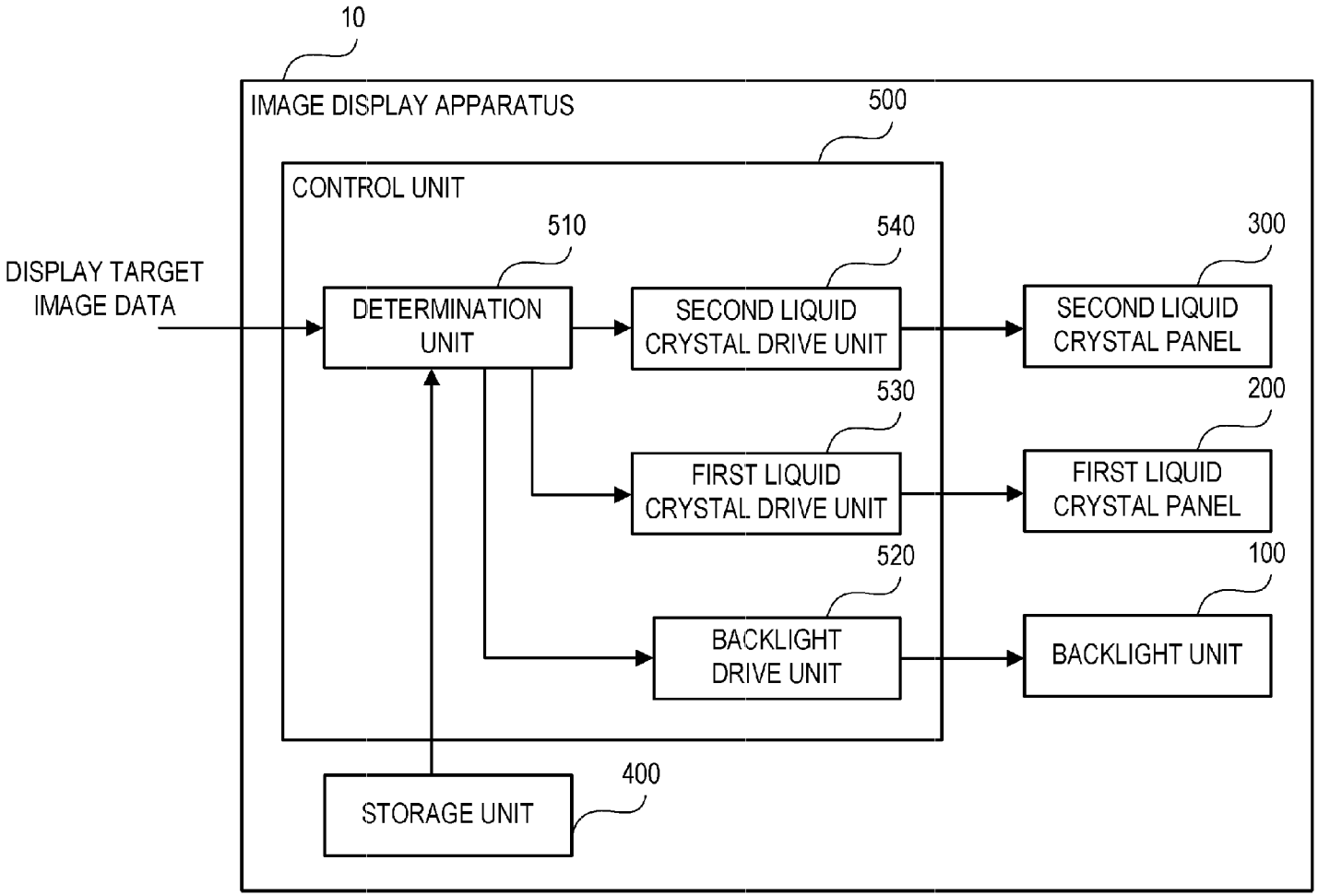
FIG. 1 shows an example of the configuration of an image display apparatus according to Embodiments 1 and 2.

FIG. 1 shows an example of a configuration of the image display apparatus 10 according to this example. The image display apparatus 10 has a backlight unit 100, a first liquid crystal panel 200, a second liquid crystal panel 300, a storage unit 400 and a control unit 500.

The backlight unit 100 is a light emitting unit configured to emit light.

The first liquid crystal panel 200 is a first transmission panel through which the light emitted from the backlight unit 100 passes.

The second liquid crystal panel 300 is a second transmission panel where the light transmitted through the first liquid crystal panel 200 transmits. An image is displayed on the screen of the image display apparatus 10 in a case where the light transmits through the first liquid crystal panel 200 that is transmitting through the second liquid crystal panel 300.

The transmission panel is not limited to the liquid crystal panel having liquid crystal elements. For example, the transmission panel may be an MEMS shutter type panel which uses a micro electromechanical system (MEMS) shutter, instead of liquid crystal elements.

The storage unit 400 stores a plurality of information including first power information, second power information and third power information. The first power information is information representing the correspondence between emission brightness of the backlight unit 100 and power consumption of the backlight unit 100. The second power information is information representing to the correspondence between transmittance of the first liquid crystal panel 200 and power consumption of the first liquid crystal panel 200. The third power information is information representing the correspondence between transmittance of the second liquid crystal panel 300 and power consumption of the second liquid crystal panel. Each of the first power information, the second power information and the third power information may be information determined by the manufacturer in advance, or may be information which the user can set and change.

The control unit 500 acquires display target image data. In this example, image data inputted to the image display apparatus 10 (input image data) is inputted to the control unit 500 as the display target image data. Based on the first power information, the second power information, the third power information and the display target image data, the control unit 500 controls the emission brightness of the backlight unit 100, the transmittance of the first liquid crystal panel 200, and the transmittance of the second liquid crystal panel 300. In concrete terms, these three values are controlled such that the display target image is displayed at a lower total power consumption (total power consumption of the image display apparatus 10) and at substantially the same brightness (display brightness) compared with the case of fixing the emission brightness of the backlight unit 100. In this example, the meaning of "substantially the same" includes "precisely the same". The display target image is an image based on the display target image data. In this example, the total value of the power consumption of the backlight unit 100, the power consumption of the first liquid crystal panel 200 and the power consumption of the second liquid crystal panel 300 is regarded as the total power consumption of the image display apparatus 10, to simplify explanation.

The display target image data is not limited to the input image data. For example, the image display apparatus 10 may have an image processing unit which performs image processing for the input image data and the image data after the image processing may be inputted to the control unit 500 as the display target image data.

The liquid crystal panel according to this example will be described in detail.

Figure 2:
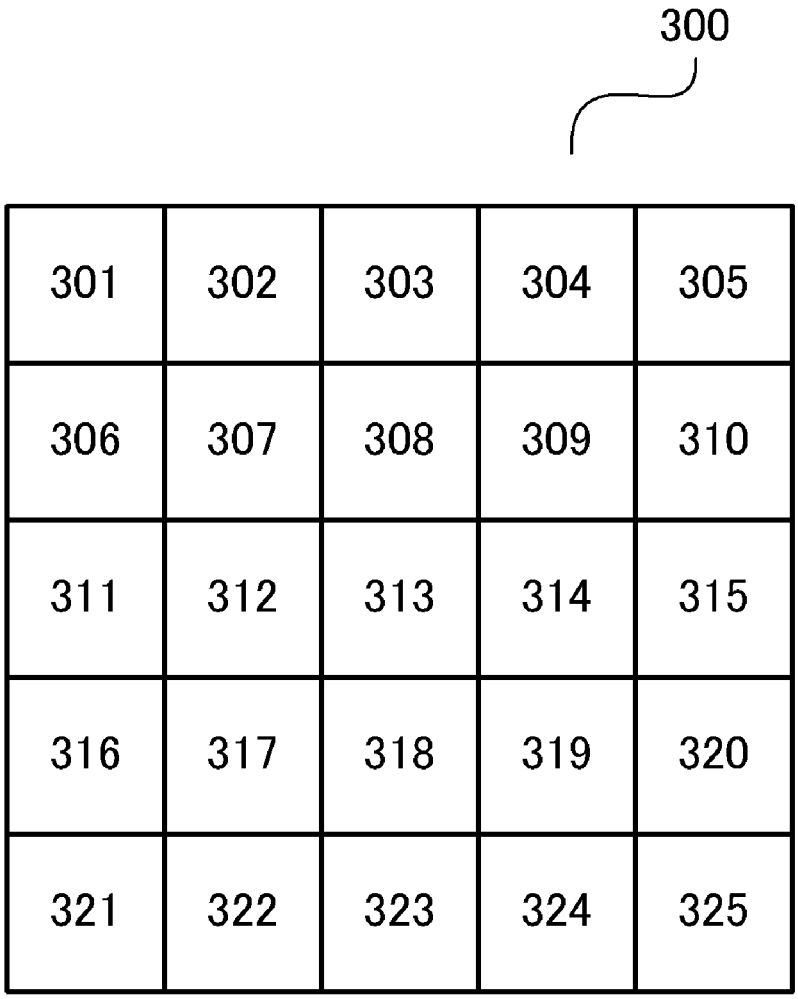
FIG. 2 shows an example of the configuration of a second liquid crystal panel according to Embodiments 1 and 2.

The second liquid crystal panel 300 has a plurality of liquid crystal elements. In this example, the second liquid crystal panel 300 has a total of 25 (5 horizontal×5 vertical) liquid crystal elements 301 to 325, as shown in FIG. 2. FIG. 2 shows the second liquid crystal panel 300 viewed in a direction perpendicular to the screen. The light transmitted through the first liquid crystal panel 200 transmits through the liquid crystal elements 301 to 325 respectively. The transmittance of each liquid crystal element 301 to 325 can be changed independently.

The number of liquid crystal elements of the second liquid crystal panel 300 may be greater or lesser than 25. Normally the second liquid crystal panel 300 includes more than 25 liquid crystal elements.

In FIG. 2, the plurality of liquid crystal elements are disposed in a matrix, but the arrangement of the plurality of liquid crystal elements is not limited to this. For example, the plurality of liquid crystal elements may be disposed in a staggered arrangement.

Figure 3:
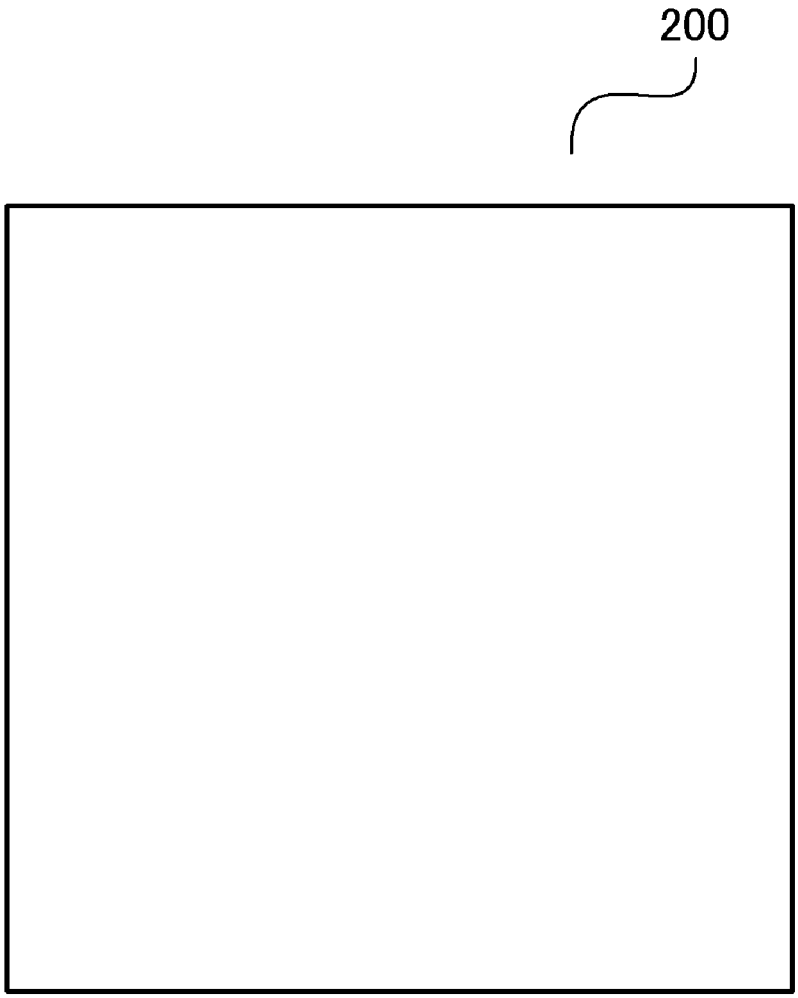
FIG. 3 shows an example of the configuration of a first liquid crystal panel according to Embodiment 1.

The first liquid crystal panel 200 has one or more liquid crystal elements. In this example, the first liquid crystal panel 200 has one liquid crystal element, as shown in FIG. 3. FIG. 3 shows the first liquid crystal panel 200 viewed in a direction perpendicular to the screen. The light emitted from the backlight unit 100 transmits through the liquid crystal element of the first liquid crystal panel 200, and is then irradiated to each liquid crystal element 301 to 325.

The first liquid crystal panel 200 may have a plurality of liquid crystal elements.

The structure of the liquid crystal element can be any structure that can control the transmittance. For example, an in plane switching (IPS) type liquid crystal element, a vertical alignment (VA) type liquid crystal element, a polymer dispersed liquid crystal (PDLC) element or the like can be used for the liquid crystal element.

The characteristics of the liquid crystal element and a method for controlling the transmittance of the liquid crystal element are not especially limited. For example, by inputting a liquid crystal drive signal having an 8-bit value (0 to 255) to a liquid crystal element, the transmittance of the liquid crystal element is controlled to a transmittance X % corresponding to the liquid crystal drive signal according to a predetermined gamma curve. A gamma curve is a curve (function) that indicates a correspondence between the value of the liquid crystal drive signal and the transmittance, and the predetermined gamma curve is, for example, a gamma curve of the gamma value=2.2. If the transmittance of the liquid crystal element is controlled to X %, then X % of the light irradiated to the liquid crystal element transmits through the liquid crystal element. If the transmittance of the liquid crystal element is controlled to 0%, the light irradiated to the liquid crystal element is almost completely shielded by the liquid crystal element. If the transmittance of the liquid crystal element is controlled to 100%, the light irradiated to the liquid crystal element almost completely transmits through the liquid crystal element. In this example, to simplify explanation, it is assumed that the predetermined gamma curve is a gamma curve with gamma value=1.0, and that the power consumption of the liquid crystal panel is in proportion to the transmittance of the liquid crystal panel and transmission size. The transmission size is a size of a region where the transmittance is uniform.

The backlight unit 100 will now be described in detail.

Figure 4:
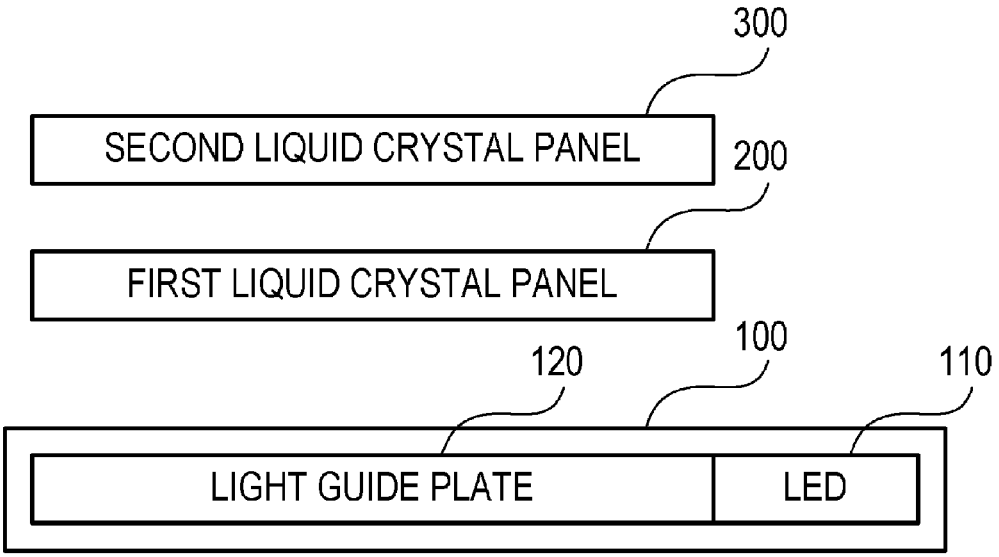
FIG. 4 shows an example of the configuration of a backlight unit according to Embodiment 1.

The backlight unit 100 has one or more light source (s). As shown in FIG. 4, the backlight unit 100 is a side type backlight apparatus, which includes and LED 110 and a light guide plate 120. FIG. 4 shows the backlight unit 100 viewed in a direction parallel with the screen. FIG. 4 also shows a first liquid crystal panel 200 and a second liquid crystal panel 300. The light, emitted from the LED 110, enters into the light guide plate 120 for the side surface of the light guide plate 120, is diffused inside the light guide plate 120, and is emitted from the front surface (surface on the first liquid crystal panel 200 side) of the light guide plate 120. The light emitted from the backlight unit 100 is irradiated to the entire first liquid crystal panel 200. The emission brightness of the backlight unit 100 is controlled by controlling the emission brightness of the LED 110 (light source). In this example, by inputting a light source drive signal to the LED 110, the emission brightness of the LED 110 is controlled to the emission brightness corresponding to the light source drive signal, and the emission brightness of the backlight unit 100 is also controlled to the emission brightness corresponding to the light source drive signal.

The light source is not limited to an LED. For example, an organic EL element, a cold cathode fluorescent lamp (CCFL) or the like may be used for the light source.

The structure of the backlight unit 100 can be any structure that can control the emission brightness. For example, a direct backlight apparatus may be used as the backlight unit 100.

The characteristics of the backlight unit 100 and the method for controlling the emission brightness of the backlight unit 100 are not especially limited. In this example, a % symbol is used to indicate the unit of the emission brightness to simplify explanation. In concrete terms, it is assumed that the maximum value of the emission brightness is 100% and the minimum value of the emission brightness (value corresponding to the OFF state) is 0%. It is assumed that the power consumption of the backlight unit 100 is in proportion to the emission brightness of the backlight unit 100.

The control unit 500 will be described in detail.

As shown in FIG. 1, the control unit 500 has a determination unit 510, a backlight drive unit 520, a first liquid crystal drive unit 530, and a second liquid crystal drive unit 540.

The determination unit 510 determines the emission brightness of the backlight unit 100, the transmittance of the first liquid crystal panel 200, and the transmittance of the second liquid crystal panel 300 based on the first power information, the second power information, the third power information and the display target image data. The transmittance is determined for each liquid crystal element. If the emission brightness of the backlight unit 100 is increased to double, the transmittance of the first liquid crystal panel 200 and/or the transmittance of the second liquid crystal panel 300 is/are reduced, then the display brightness (brightness on screen) can be kept constant. In concrete terms, the transmittance of the first liquid crystal panel 200 and/or the transmittance of the second liquid crystal panel 300 is/are reduced, so that the value generated by multiplying the transmittance of the first liquid crystal panel 200 by the transmittance of the second liquid crystal panel 300 is reduced to half, then the display brightness can be kept constant.

The backlight drive unit 520 supplies a light source drive signal to the backlight unit 100, so that the emission brightness of the backlight unit 100 is controlled to the emission brightness determined by the determination unit 510. The emission brightness of the backlight unit 100 can be changed by changing at least one of the magnitude of the light source drive signal and the supply time to supply the light source drive signal to the backlight unit 100. The light source drive signal is voltage to be applied to the backlight unit 100, current to be supplied to the backlight unit 100 or the like. As the voltage to be applied to the backlight unit 100 becomes larger, the emission brightness of the backlight unit 100 is controlled to a higher value. As the total time to apply the voltage to the backlight unit 100 becomes longer, the emission brightness of the backlight unit 100 is controlled to a higher value. The light source drive signal may be intermittently supplied to the backlight unit 100, such that turning the backlight unit 100 ON and OFF are repeated.

The first liquid crystal drive unit 530 supplies the liquid crystal drive signal (first liquid crystal drive signal) to the first liquid crystal panel 200 so that the transmittance of the first liquid crystal panel 200 is controlled to the transmittance determined by the determination unit 510. The liquid crystal drive signal is voltage to be applied to the liquid crystal panel (liquid crystal element), current to be supplied to the liquid crystal panel or the like.

The second liquid crystal drive unit 540 supplies the liquid crystal drive signal (second liquid crystal drive signal) to the second liquid crystal panel 300 so that the transmittance of the second liquid crystal panel 300 is controlled to the transmittance determined by the determination unit 510.

The emission brightness of the backlight unit 100, the transmittance of the first liquid crystal panel 200, and the transmittance of the second liquid crystal panel 300 are synchronously controlled.

The determination unit 510 will be described in more detail, with reference to FIGS. 5A to 5D, 6A, 6B and 7.

FIG. 5A shows an example of a plurality of pixels constituting a display target image. In the example in FIG. 5A, the display target image is constituted by a total of 25

(5 horizontal×5 vertical) pixels 401 to 425. The pixels 401 to 425 correspond to the liquid crystal elements 301 to 325 in FIG. 2.

The number of pixels constituting the display target image may be greater or lesser than 25. Normally the display target image is constituted by more than 25 pixels.

FIG. 5B to FIG. 5D show examples of data brightness (brightness of the display target image data (brightness value)) of the pixel 401 to pixel 425 respectively. In Embodiment 1, a % is used as a unit of the data brightness. In concrete terms, the maximum value of the data brightness (value corresponding to white) is 100%, and the minimum value of the data brightness (value corresponding to black) is 0%. In FIG. 5B, the data brightness of all the pixels is 50% (value corresponding to gray).

FIG. 6A shows an example of first power information. In the example in FIG. 6A, the power consumption of the backlight unit 100 is 0 W in a case where the emission brightness of all the light sources of the backlight unit 100 is 0% (OFF state), and the power consumption of the backlight unit 100 is 50 W in a case where the emission brightness of all the light sources of the backlight unit 100 is 100%.

FIG. 6B shows an example of second power information and third power information. In the example in FIG. 6B, the power consumption of the first liquid crystal panel 200 is 5 W in a case where the transmittance of all the liquid crystal elements of the first liquid crystal panel 200 is 0%, and the power consumption of the first liquid crystal panel 200 is 10 W in a case where the transmittance of all the liquid crystal elements of the first liquid crystal panel 200 is 100%. The power consumption of the second liquid crystal panel 300 is 5 W in a case where the transmittance of all the liquid crystal elements of the second liquid crystal panel 300 is 0%, and the power consumption of the second liquid crystal panel 300 is 10 W in a case where the transmittance of all the liquid crystal elements of the second liquid crystal panel 300 is 100%.

In FIG. 6A and FIG. 6B, the tables are shown as the power information, but the power information may be functions [instead of tables].

Now a case where the data brightness of the display target image is the data brightness shown in FIG. 5B is considered. In this case, the emission brightness of all the light sources of the backlight unit 100 is controlled to 100%, the transmittance of all the liquid crystal elements of the first liquid crystal panel 200 is controlled to 100%, and the transmittance of all the liquid crystal elements of the second liquid crystal panel 300 is controlled to 50%, for example. Thereby, a display brightness equivalent to the data brightness of the display target image can be implemented. In this case, the power consumption of the backlight unit 100 is 50 W, the power consumption of the first liquid crystal panel 200 is 10 W, and the power consumption of the second liquid crystal panel 300 is 7.5 W, therefore the total power consumption of the image display apparatus 10 is 67.5 W (=50 W+10 W+7.5 W).

The determination unit 510 determines the emission brightness of the backlight unit 100, the transmittance of the first liquid crystal panel 200, and the transmittance of the second liquid crystal panel 300, so that the change of the display brightness in the image display apparatus 10 is suppressed, and the total power consumption of the image display apparatus 10 is reduced.

Figure 7:
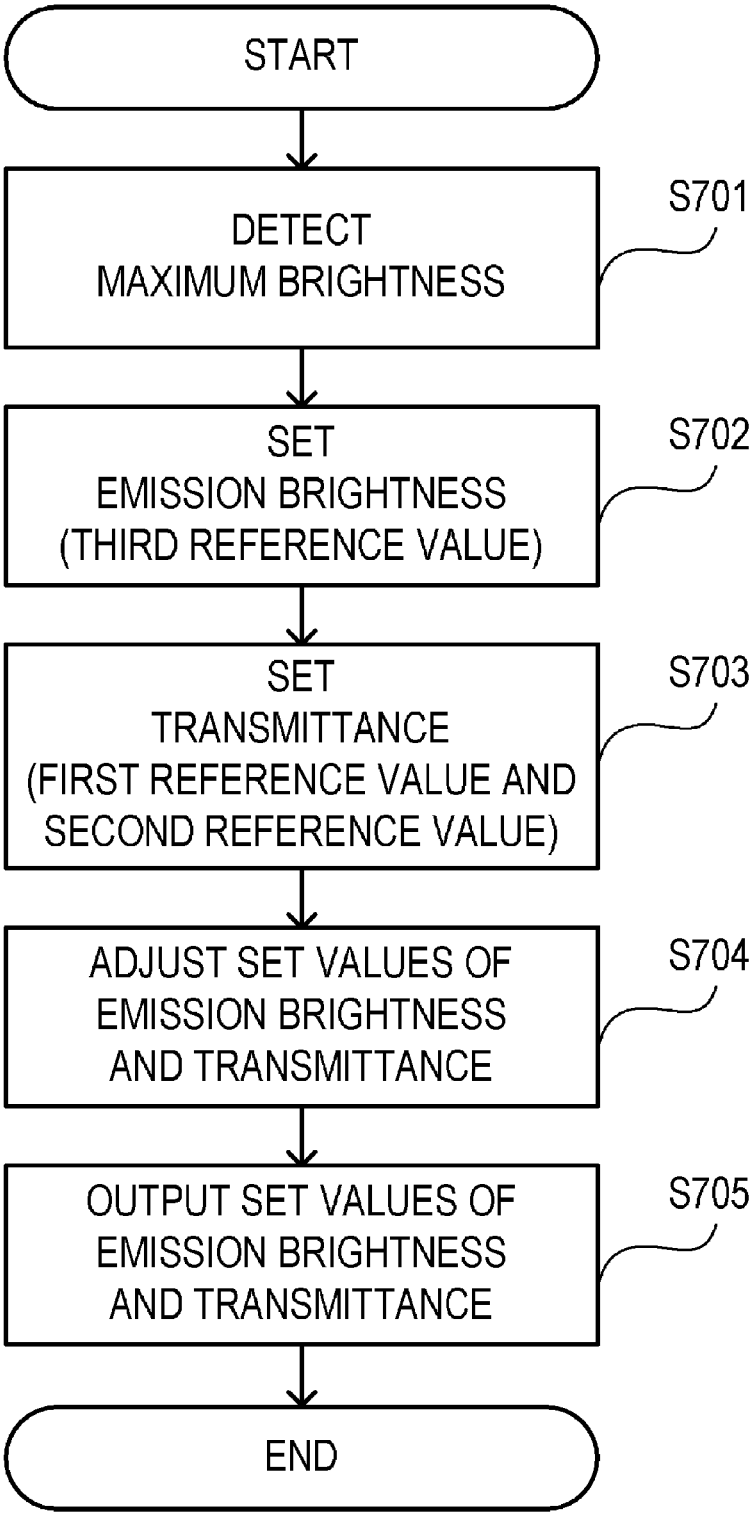
FIG. 7 is a flow chart depicting an example of a processing flow of a determination unit according to Embodiments 1 and 2.

An example of the processing flow of the determination unit 510 will be described with reference to FIG. 7. FIG. 7 is a flow chart depicting an example of the processing flow of the determination unit 510. The processing flow in FIG. 7 starts in response to the input of the display target image data to the determination unit 510 for example.

In the example described herein below, the emission brightness of the backlight unit 100, the transmittance of the first liquid crystal panel 200 and the transmittance of the second liquid crystal panel 300 are determined so that the total power consumption of the image display apparatus 10 is minimized, but [the present invention] is not limited to this. All that is required is that the total power consumption of the image display apparatus 10 is lower than the case of fixing the emission brightness of the backlight unit 100.

A case where the data brightness of the display target image is the data brightness shown in FIG. 5B will be described.

First the determination unit 510 detects the maximum brightness of the display target image data from the display target image data (S701). Here the data brightness of all the pixels is 50%, hence 50% is detected as the maximum brightness.

Then the determination unit 510 sets a value corresponding to the maximum brightness detected in S701 (the same value as the maximum brightness) as the emission brightness of the backlight unit 100 (S702). Here the maximum brightness is 50%, hence 50% is set as the emission brightness.

Then the determination unit 510 sets the transmittance of the first liquid crystal panel 200 and the transmittance of the second liquid crystal panel 300 based on the set value of the emission brightness of the backlight unit 100 and the display target image data, so that a display brightness equivalent to the data brightness of the display target image is implemented. Here the set value of the emission brightness of the backlight unit 100 is 50%, and the data brightness of all the pixels is 50%. Therefore 100% is set as the transmittance of all the liquid crystal elements of the first liquid crystal panel 200, and 100% is set as the transmittance of all the liquid crystal elements of the second liquid crystal panel 300.

Then the determination unit 510 adjusts the values set in S702 and S703 (set values) based on the first power information, the second power information, the third power information, and the display target image data (S704). In concrete terms, the determination unit 510 calculates the total power consumption (reference power) of the image display apparatus 10 in the case of using the values set in S702 and S703, based on the first power information, the second power information, and the third power information. Then the determination unit 510 determines whether the total power consumption can be reduced to a value less than the reference power, based on the first power information, the second power information, the third power information, and the display target image data. For example, the determination unit 510 detects a control pattern by which the display brightness, substantially the same as the data brightness of the display target image, can be implemented in a case where the emission brightness of the backlight unit 100 is higher than the value set in S702. The control pattern is a combination of the emission brightness of the backlight unit 100, the transmittance of the first liquid crystal panel 200, and the transmittance of the second liquid crystal panel 300. Then the determination unit 510 calculates the total power consumption using the detected control pattern, and compares the calculated total power consumption and the reference power. Thereby it can be determined whether the total power consumption can be reduced to a value less than the reference power. If the total power consumption can be reduced, the determination unit 510 increases the set value of the emission brightness of the backlight unit 100, and decreases the set value of the transmittance of the first liquid crystal panel 200 and the set value of the transmittance of the second liquid crystal panel 300, so that the total power consumption is further reduced.

The set value of the emission brightness of the backlight unit 100 is 50%, and the power consumption of the backlight unit 100, in a case where the emission brightness of the backlight unit 100 is 50%, is 25 W. The set value of the transmittance of the first liquid crystal panel 200 and the set value of the transmittance of the second liquid crystal panel 300 are 100%. The power consumption of the first liquid crystal panel 200, in a case where the transmittance of the first liquid crystal panel 200 is 100%, is 10 W, and the power consumption of the second liquid crystal panel 300, in a case where the transmittance of the second liquid crystal panel 300 is 100%, is 10 W. Therefore the total power consumption (reference power) of the image display apparatus 10, in a case where the values set in S702 and S703 are used, is calculated as 45 W (=25 W+10 W+10 W). Since it is determined that the total power consumption cannot be reduced to a value less than the 45 W reference power, the values set in S702 and S703 are not changed.

Then the determination unit 510 outputs the set value of the emission brightness of the backlight unit 100, the set value of the transmittance of the first liquid crystal panel 200, and the set value of the transmittance of the second liquid crystal panel 300. The set value of the emission brightness of the backlight unit 100 is outputted to the backlight drive unit 520. The set value of the transmittance of the first liquid crystal panel 200 is outputted to the first liquid crystal drive unit 530. The set value of the transmittance of the second liquid crystal panel 300 is outputted to the second liquid crystal drive unit 540. If the set values are adjusted in S704, the adjusted set values are outputted, and if the set values are not adjusted in S704, the set values determined in S702 and S703 are outputted. And since the set values are not adjusted in S704 in this example, the set values determined in S702 and S703 are outputted.

By the above processing, the total power consumption of the image display apparatus 10 can be reduced from 67.5 W to 45 W, while suppressing the change of the display brightness of the image display apparatus 10.

The processing flow of the determination unit 510 is not limited to the processing flow in FIG. 7. For example, all the control patterns that can implement a display brightness equivalent to the data brightness of the display target image may be detected, so that a control pattern, by which power consumption is the lowest, is selected and set from all the detected control patterns.

An example of the processing flow of the determination unit 510, in a case where the data brightness of the display target image is the data brightness shown in FIG. 5C, will be described. In FIG. 5C, the data brightness of all the pixels is 1% (a value corresponding to dark gray). In this case, the emission brightness of all the light sources of the backlight unit 100 is controlled to 100%, the transmittance of all the liquid crystal elements of the first liquid crystal panel 200 is controlled to 100%, and the transmittance of all the liquid crystal elements of the second liquid crystal panel 300 is controlled to 1%, for example. Thereby a display brightness equivalent to the data brightness of the display target image can be implemented. In this case, the power consumption of the backlight unit 100 is 50 W, the power consumption of the first liquid crystal panel 200 is 10 W, and the power consumption of the second liquid crystal panel 300 is 5.05 W, therefore the total power consumption of the image display apparatus 10 is 65.05 W (=50 W+10 W+5.05 W).

First the maximum brightness is detected as 1%, since the data brightness of all the pixels is 1% (S701).

Then since the maximum brightness is 1%, 1% is set as the emission brightness of the backlight unit 100 (S702).

Then 100% is set as the transmittance of the first liquid crystal panel 200, and 100% is set as the transmittance of the second liquid crystal panel 300.

Then the processing in S704 is performed.

The set value of the emission brightness of the backlight unit 100 is 1%, and the power consumption of the backlight unit 100, in a case where the emission brightness of the backlight unit 100 is 1%, is 0.5 W. The set value of the transmittance of the first liquid crystal panel 200 and the set value of the transmittance of the second liquid crystal panel 300 are 100%. The power consumption of the first liquid crystal panel 200, in a case where the transmittance of the first liquid crystal panel 200 is 100%, is 10 W, and the power consumption of the second liquid crystal panel 300, in a case where the transmittance of the second liquid crystal panel 300 is 100%, is 10 W. Therefore the total power consumption (reference power) of the image display apparatus 10, in a case where the values set in S702 and S703 are used, is calculated as 20.5 W (=0.5 W+10 W+10 W).

Then the combination of the 4% emission brightness of the backlight unit 100, the 50% transmittance of the first liquid crystal panel 200, and the 50% transmittance of the second liquid crystal panel 300 is detected as the control pattern that can implement the 1% display brightness. In the detected control pattern, the power consumption of the backlight unit 100 is 2 W, the power consumption of the first liquid crystal panel 200 is 7.5 W, and the power consumption of the second liquid crystal panel 300 is 7.5 W. Therefore, as the total consumption with the detected control pattern, 17 W, which is lower than the reference power 20.5 W, is calculated. As a result, it is determined that the total power consumption can be reduced to a value less than the 20.5 W reference power. Then the set value of the emission brightness of the backlight unit 100 is adjusted to 4%, the set value of the transmittance of the first liquid crystal panel 200 is adjusted to 50%, and the set value of the transmittance of the second liquid crystal panel 300 is adjusted to 50%.

The above describes the processing in S704.

Then the 4% set value of the emission brightness of the backlight unit 100, the 50% set value of the transmittance of the first liquid crystal panel 200, and the 50% set value of the transmittance of the second liquid crystal panel 300 are outputted from the determination unit 510 (S705).

By the above processing, the total power consumption of the image display apparatus 10 can be reduced from 65.05 W to 17 W, while suppressing the change of the display brightness of the image display apparatus 10. Even if the values set in S702 and S703 are used, the total power consumption of the image display apparatus 10 can be reduced from 65.05 W to 20.5 W. Therefore the value set in S702 and S703 may be used as the final set values without performing the processing in S704.

An example of the processing flow of the determination unit 510, in a case where the data brightness of the display target image is the brightness shown in FIG. 5D, will be described. In FIG. 5D, the data brightness of the pixel 413 is 100%, and the data brightness of other pixels is 50%. In this case, the emission brightness of all the light sources of the backlight unit 100 is controlled to 100%, and the transmittance of all the liquid crystal elements of the first liquid crystal panel 200 is controlled to 100%. Then the transmittance of the liquid crystal element 313 of the second liquid crystal panel 300 is controlled to 100%, and the transmittance of the remaining 24 liquid crystal elements of the second liquid crystal panel 300 is controlled to 50%. Thereby a display brightness equivalent to the data brightness of the display target image can be implemented. In this case, the power consumption of the backlight unit 100 is 50 W, and the power consumption of the first liquid crystal panel 200 is 10 W. The power consumption of the second liquid crystal panel 300, in a case where the transmittance of the liquid crystal element 313 is controlled to 100%, is 0.4 W (=10 W×(1/25)). The power consumption of the second liquid crystal panel 300, in a case where the transmittance of the remaining 24 liquid crystal elements is controlled to 50%, is 7.2 W (=7.5 W×(24/25)). Therefore the total power consumption of the image display apparatus 10 is 67.6 W (=50 W+10 W+0.4 W+7.2 W).

In this example, the control unit 500 further performs a processing to detect, from the region of the display target image, a bright point region of which data brightness is higher than a neighboring region (adjacent region) by a first threshold or more and of which size is a second threshold or less, based on the display target image data. Then the control unit 500 controls the emission brightness of the backlight unit 100 without considering the image data in the bright point region.

At least one of the first threshold and the second threshold may be a value determined by the manufacturer in advance, or may be a value which the user can set and change. In this example, the first threshold is 80% of the data brightness of the adjacent region (adjacent pixel), and the second threshold is a size of one pixel, but the first threshold and the second threshold are not limited to these values.

The emission brightness may be controlled considering the image data in the bright point region. The image display apparatus 10 may have two operation modes: a bright point considering mode in which the image data in the bright point region is considered; and a bright point non-considering mode in which the image data in the bright point is not considered. The image display apparatus 10 may further have a setting unit that selects and sets either one of the bright point considering mode and the bright point non-considering mode. Either one of the bright point considering mode and the bright point non-considering mode may be selected and set automatically, or either one of the bright point considering mode and the bright point non-considering mode may be selected and set by user operation.

First, the determination unit 510 detects the bright point region based on the display target image data, and detects the maximum brightness in a region other than the bright point region (S701). Here the region of the pixel 413 is detected as the bright point region. The data brightness of all the pixels, other than the pixel 413, is 50%, hence 50% is detected as the maximum brightness.

Then since the maximum brightness is 50%, 50% is set as the emission brightness of the backlight unit 100.

Then 100% is set as the transmittance of the first liquid crystal panel 200, and 100% is set as the transmittance of the second liquid crystal panel 300.

Then the processing in S704 is performed.

The set value of the emission brightness of the backlight unit 100 is 50%, and the power consumption of the backlight unit 100, in a case where the emission brightness of the backlight unit 100 is 50%, is 25 W. The set value of the transmittance of the first liquid crystal panel 200 and the set value of the transmittance of the second liquid crystal panel 300 are 100%. The power consumption of the first liquid crystal panel 200, in a case where the transmittance of the first liquid crystal panel 200 is 100%, is 10 W, and the power consumption of the second liquid crystal panel 300, in a case where the transmittance of the second liquid crystal panel 300 is 100%, is 10 W. Therefore the total power consumption (reference power) of the image display apparatus 10, in a case where the values set in S702 and S703 are used, is calculated as 45 W (=25 W+10 W+10 W). Since it is determined that the total power consumption cannot be reduced to a value less than the 45 W reference power, the values set in S702 and S703 are not changed.

Then the determination unit 510 outputs 50% as the set value of the emission brightness of the backlight unit 100, 100% as the set value of the transmittance of the first liquid crystal panel 200, and 100% as the set value of the transmittance of the second liquid crystal panel 300 (S705).

By the above processing, the total power consumption of the image display apparatus 10 can be reduced from 67.6 W to 45 W, while suppressing the change of the display brightness of the image display apparatus 10.

As described above, according to this example, the emission brightness of the backlight unit 100, the transmittance of the first liquid crystal panel 200, and the transmittance of the second liquid crystal panel 300 are controlled based on the first power information, the second power information, the third power information, and the display target image data. Thereby the total power consumption of the image display apparatus can be reduced, while suppressing the change of the display brightness of the image display apparatus having two transmission panels (liquid crystal panels).

The power consumption of the backlight unit can be further reduced by controlling the emission brightness of the backlight unit considering the relationship of the drive method of the backlight unit and the emission efficiency (e.g. emission brightness per unit power) of the backlight unit. As a result, the total power consumption of the image display apparatus can be further reduced. As the magnitude of the light source drive signal to drive the backlight unit is higher, the power consumption of the backlight unit increases, and as the supply time to supply the light source drive signal to the backlight unit is longer, the power consumption of the backlight unit increases. It is known that the emission efficiency of the backlight unit increases if the magnitude of the light source drive signal to drive the backlight unit is reduced. For example, it is known that the emission efficiency of an LED increases if the value of the current supplied to an LED is reduced. Therefore, it is preferable to control the emission brightness of the backlight unit by controlling at least one of the magnitude of the light source drive signal and the supply time of the light source drive signal, such that the magnitude of the light source drive signal is controlled to a smaller value. For example, in order to reduce the emission brightness of the backlight unit to half, it is preferable to reduce the magnitude of the light source drive signal to half or less, and increase the supply time of the light source drive signal to double. Thereby the power consumption of the backlight unit can be further reduced, and as a result, the total power consumption of the image display apparatus can be further reduced.

The backlight unit may have a first light emitting unit and a second light emitting unit of which emission efficiency is higher than the first light emitting unit. Having a higher emission efficiency than the first light emitting unit means that light is emitted at a higher emission brightness than the first light emitting unit, with power consumption the same as the first light emitting unit. In this case, it is preferable to control the emission brightness of the backlight unit by controlling at least one of the emission brightness of the first light emitting unit and the emission brightness of the second light emitting unit, so that the emission brightness of the first light emitting unit is controlled to be a lower value. Here a case where the backlight unit has an RGB type light emitting unit and a phosphor type light emitting unit is considered. The RGB type light emitting unit is a light emitting unit having a red LED which emits red light, a green LED which emits green light, and a blue LED which emits blue light. From the RGB type light emitting unit, white light generated by combining the red light emitted from the red LED, green light emitted from the green LED, and blue light emitted from the blue LED is emitted. The phosphor type light emitting unit is a light emitting unit having a blue LED which emits blue light, and a phosphor which emits yellow light (yellow phosphor) by irradiation of blue light emitted from the blue LED. From the phosphor type light emitting unit, white light generated by combining the blue light emitted from the blue LED and yellow light emitted from the yellow phosphor is emitted. It is known that the RGB type light emitting unit has a lower emission efficiency compared with the phosphor type light emitting unit. Therefore, in this case, it is preferable that at least one of the emission brightness of the RGB type light emitting unit and the emission brightness of the phosphor type light emitting unit is controlled so that the emission brightness of the RGB type light emitting unit is controlled to a lower value. Thereby the power consumption of the backlight can be further reduced, and as a result, the total power consumption of the image display apparatus can be further reduced.

It is known that the emission brightness of the backlight unit is changed by the change in the temperature around the backlight unit, deterioration of the backlight unit or the like. Therefore it is preferable that the image display apparatus further has a photosensor to detect light emitted from the backlight unit. It is also preferable that the emission brightness of the backlight unit, the transmittance of the first liquid crystal panel and the transmittance of the second liquid crystal panel are controlled, additionally considering the change of the detection values of the photosensor due to the change of the emission characteristic of the backlight unit. For example, it is preferable to increase/decrease the emission brightness of the backlight unit or increase/decrease the transmittance of the liquid crystal panels according to the change of the detection values of the photosensor due to the change of the emission characteristic of the backlight unit. The installation position of the photosensor can be any position at which the change of the emission characteristic of the backlight unit can be detected. For example, the photosensor may be installed near the backlight unit, or may be installed at a position where the light emitted from the backlight unit and transmitted through the liquid crystal panels can be detected.

In Embodiment 1, an example of an image display apparatus that displays monochrome images (monochrome display apparatus) was described, but by performing the same processing for an image display apparatus that displays color images (color display apparatus), the total power consumption of the image display apparatus can be reduced. If the image display apparatus is a color image display apparatus, it is preferable that the backlight unit has a plurality of light sources of which emission colors are different from one another. It is also preferable that the emission brightness of each light source is controlled so that the emission colors of the backlight unit become similar to the colors of the image represented by the display target image data. Here a case where the backlight unit has a red LED, a green LED and a blue LED, and the brightness of red is 100%, the brightness of green is 50% and the brightness of blue is 0% in colors of the image represented by the display target image data is considered. In this case, it is preferable to control the emission brightness of the red LED to 100%, the emission brightness of the green LED to 50%, and the emission brightness of the blue LED to 0%. Thereby the power consumption of the backlight unit can be further reduced, and as a result, the total power consumption of the image display apparatus can be further reduced.

Embodiment 2

An image display apparatus according to Embodiment 2 of the present invention and a control method thereof will now be described. In Embodiment 2, a configuration, where the transmittance of the first liquid crystal panel and the emission brightness of the backlight unit can be partially changed, will be described. Configuration and processing different from Embodiment 1 will be described in detail herein below, and description on configuration and processing the same as Embodiment 1 is omitted.

Figure 8:
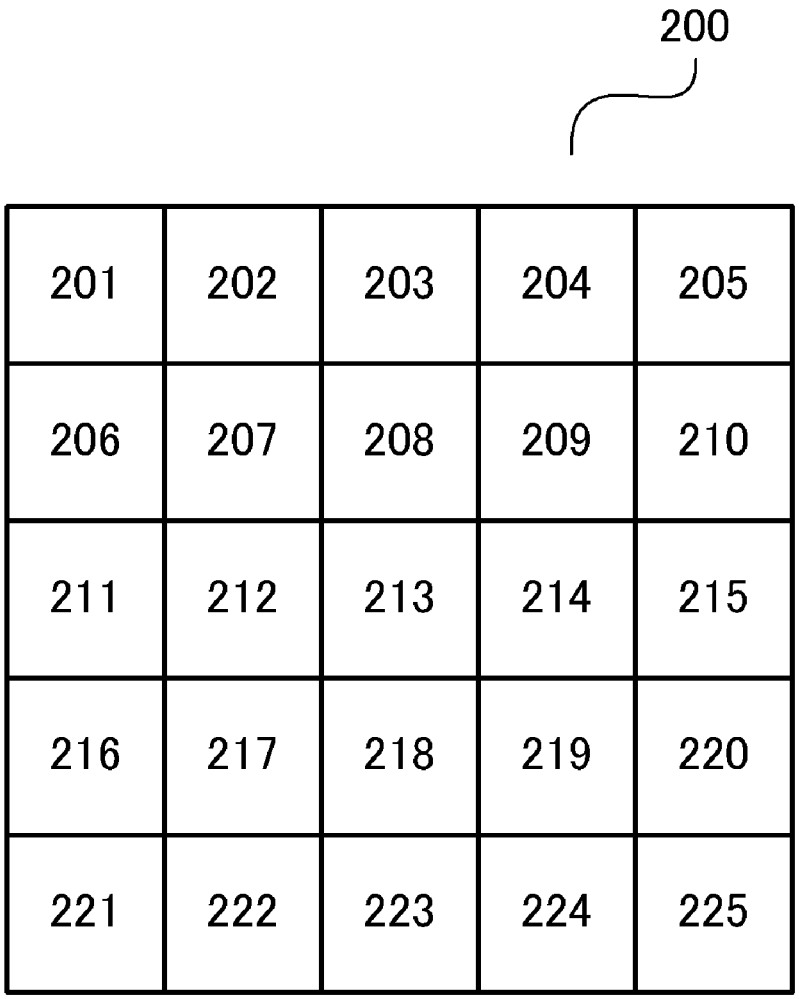
FIG. 8 shows an example of a first liquid crystal panel according to Embodiment 2.

A first liquid crystal panel 200 according to this example has a plurality of liquid crystal elements. In this example, the first liquid crystal panel 200 has a total of 25 (5 horizontal×5 vertical) liquid crystal elements 201 to 225, as shown in FIG. 8. The liquid crystal elements (first liquid crystal elements) 201 to 225 correspond to the liquid crystal elements (second liquid crystal elements) 301 to 325 in FIG. 2. In Embodiment 2, it is assumed that light transmitted through a first liquid crystal element is irradiated only to a second liquid crystal element corresponding to the first liquid crystal element to simplify explanation. For example, light transmitted through the first liquid crystal element 201 is irradiated only to the second liquid crystal element 301.

The light transmitted through a first liquid crystal element may be diffused and irradiated to a corresponding second liquid crystal element and neighboring second liquid crystal elements thereof.

A number of liquid crystal elements of the first liquid crystal panel 200 may be greater or lesser than a number of liquid crystal elements of the second liquid crystal panel 300.

Figure 9:
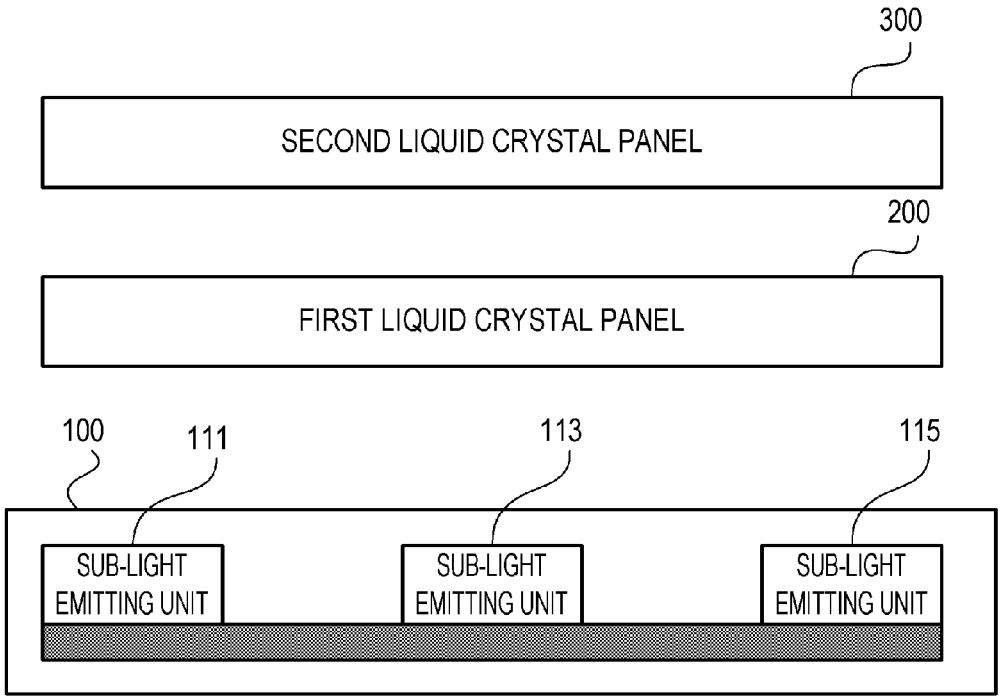
FIG. 9 shows an example of the configuration of a backlight unit according to Embodiment 2.
Figure 10:
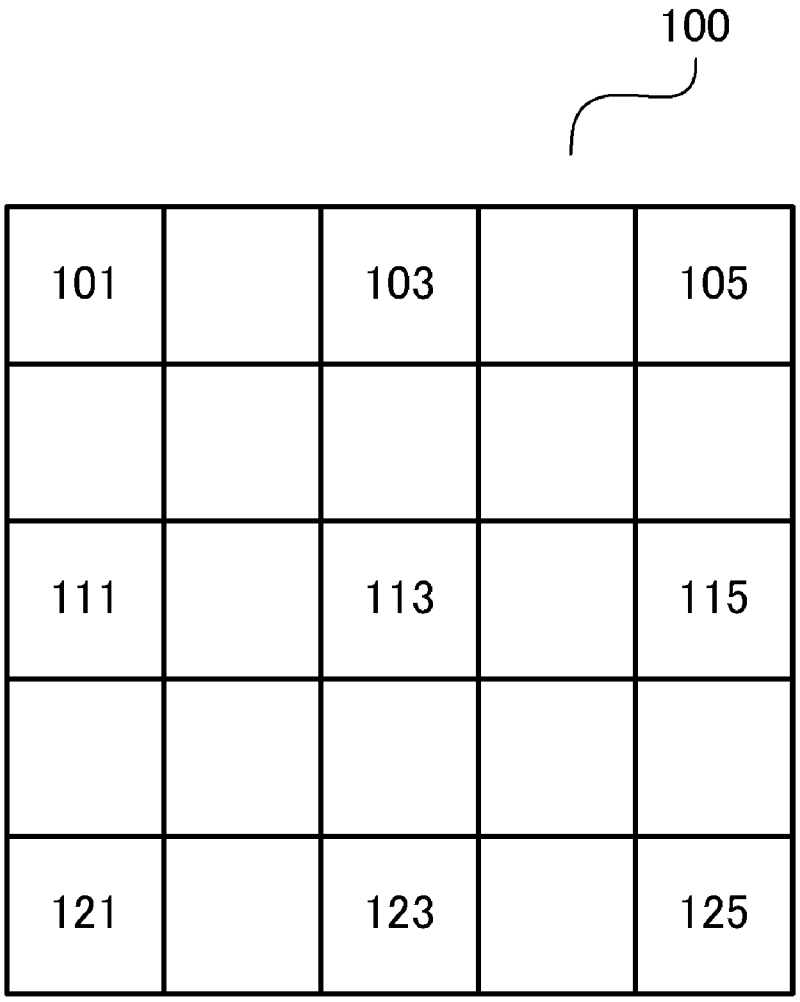
FIG. 10 shows an example of the configuration of a backlight unit according to Embodiment 2.

A backlight unit 100 according to this example has a plurality of sub-light emitting units of which corresponding regions on the screen are different from one another. For example, the backlight unit 100 is a direct backlight apparatus which has a plurality of sub-light emitting units, as shown in FIG. 9. Each sub-light emitting unit has at least one light source. In this example, the backlight unit 100 has 9 sub-light emitting units: 101, 103, 105, 107, 109, 111, 113, 115, 121, 123 and 125, as shown in FIG. 10. The sub-light emitting units 101, 103, 105, 107, 109, 111, 113, 115, 121, 123 and 125 correspond to the liquid crystal elements 301, 303, 305, 307, 309, 311, 313, 315, 321, 323 and 325 in FIG. 2. In this example, most of the light emitted from a sub-light emitting unit is irradiated to a region of the corresponding liquid crystal element. The light omitted from the sub-light emitting unit is also diffused and irradiated to a region other than the region of the corresponding liquid crystal element. In this example, it is assumed that the maximum value of the emission brightness of each sub-light emitting unit is higher than 100%.

The number of sub-light emitting units of the backlight unit 100 may be greater or lesser than the number of liquid crystal elements of the first liquid crystal panel 200, and may be greater or lesser than the number of liquid crystal elements of the second liquid crystal panel 300.

A region (corresponding region) that corresponds to a sub-light emitting unit may be a region that includes a plurality of liquid crystal elements. A plurality of corresponding regions, which correspond to a plurality of sub-light emitting units, may be a plurality of divided regions constituting the region on the screen. The corresponding regions may overlap between the sub-light emitting units.

The light emitted from a sub-light emitting unit may be irradiated only to the corresponding region.

A control unit 500 according to this example controls the emission brightness of the backlight unit 100, the transmittance of the first liquid crystal panel 200, and the transmittance of the second liquid crystal panel 300 based on first power information, second power information, third power information and display target image data. In this example as well, these three values are controlled such that the display target image is displayed at a lower total power consumption (total power consumption of the image display apparatus 10), and at a substantially same display brightness compared with the case of fixing the emission brightness of the backlight unit 100. In this example, however, the emission brightness of each sub-light emitting unit can be independently controlled. Therefore the total power consumption of the image display apparatus 10 can be further reduced. Moreover, in this example, the emission brightness of each sub-light emitting unit, the transmittance of the first liquid crystal panel 200, and the transmittance of the second liquid crystal panel 300 are controlled additionally considering the diffusion of the light emitted from each sub-light emitting unit. Thereby the change of the display brightness can be further suppressed.

However, considering the diffusion of the light emitted for each sub-light emitting unit is an option.

The brightness of the light irradiated from the backlight unit 100 to the first liquid crystal element (irradiation brightness) will be described with reference to FIG. 11A to FIG. 11F.

FIG. 11A shows a state in a case where only the sub-light emitting unit 113 is turned ON. FIG. 11B shows the irradiation brightness of each first liquid crystal element in the state of FIG. 11A. FIG. 11C shows a state in a case where only the sub-light emitting unit 115 is turned ON. FIG. 11D shows the irradiation brightness of each first liquid crystal element in the state of FIG. 11C. FIG. 11E shows a state in a case where only the sub-light emitting unit 111 is turned ON. And FIG. 11F shows the irradiation brightness of each first liquid crystal element in the state of FIG. 11E. In FIGS. 11B, 11D and 11F, a value normalized such that the maximum value of the irradiation brightness is 100% is shown as the irradiation brightness. Hereafter the information to indicate the irradiation brightness of each first liquid crystal element is called "emission profile".

The emission profile shown in FIG. 11B is an emission profile corresponding to the sub-light emitting unit 113. In the emission profile corresponding to the sub-light emitting unit 113, the irradiation brightness of the first liquid crystal element 213 corresponding to the sub-light emitting unit 113 is 100%, and the irradiation brightness drops as the distance from the first liquid crystal element 213 increases.

The emission profile shown in FIG. 11D is an emission profile corresponding to the sub-light emitting unit 115. In the emission profile corresponding to the sub-light emitting unit 115, the irradiation brightness of the first liquid crystal element 215 corresponding to the sub-light emitting unit 115 is 100%, and the irradiation brightness drops as the distance from the first liquid crystal element 215 increases.

The emission profile shown in FIG. 11F is an emission profile corresponding to the sub-light emitting unit 111. In the emission profile corresponding to the sub-light emitting unit 111, the irradiation brightness of the first liquid crystal element 211 corresponding to the sub-light emitting unit 111 is 100%, and the irradiation brightness drops as the distance from the first liquid crystal element 211 increases.

In this example, the emission profile of each sub-light emitting unit is recorded in the storage unit 400 as data in advance. Then using each emission profile, control further considering the diffusion of light emitted from each sub-light emitting unit (control of emission brightness of each sub-light emitting unit, transmittance of first liquid crystal panel 200, and transmittance of second liquid crystal panel 300) is performed.

The data of the emission profile may be data created by the manufacturer in advance, or may be data which the user created by experiment or the like.

The data of the emission profile may be any data if the correspondence of the distance from the sub-light emitting unit 115 (first liquid crystal element corresponding to the sub-light emitting unit 115) and the irradiation brightness is indicated. As the data of the emission profile, a common data may be provided for a plurality of sub-light emitting units.

The processing flow of the determination unit 510 according to this example will be described with reference to FIG. 7.

FIG. 12A and FIG. 12B show examples of data brightness of the display target image.

An example of the processing flow of the determination unit 510, in a case where the data brightness of the display target image is the data brightness shown in FIG. 12A, will be described. In FIG. 12A, the data brightness of the pixel 413 is 100%, the data brightness of the pixel 414 is 15%, and the data brightness of the remaining pixels is 0%.

Since the data brightness of the pixel 413 is 100%, the data brightness of the pixel 414 is 15% and the data brightness of the remaining pixels is 0%, 100% is detected as the maximum brightness (S701).

Then since the maximum brightness is 100%, 100% is set as the emission brightness of all the sub-light emitting units (S702).

Then the processing in S703 is performed.

The set values of the emission brightness of all the sub-light emitting units are 100%, and the data brightness of the pixel 401 is 0%. Therefore the transmittance of the first liquid crystal element 201 and the transmittance of the second liquid crystal element 301 are set so that a value generated by multiplying the transmittance of the first liquid crystal element 201 by the transmittance of the second liquid crystal element 301 becomes 0%. In this example, the transmittance of the first liquid crystal element 201 and the transmittance of the second liquid crystal element 301 are set to 0%. In the same manner, the transmittance of the first liquid crystal elements 202 to 212 and 215 to 225, and the transmittance of the second liquid crystal elements 302 to 312 and 315 to 325, are set to 0%.

The set values of the emission brightness of all the sub-light emitting units are 100%, and the data brightness of the pixel 413 is 100%. Therefore the transmittance of the first liquid crystal element 213 and the transmittance of the second liquid crystal element 313 are set so that a value generated by multiplying the transmittance of the first liquid crystal element 213 by the transmittance of the second liquid crystal element 313 becomes 100%. In this example, the transmittance of the first liquid crystal element 213 and the transmittance of the second liquid crystal element 313 are set to 100%

The set values of the emission brightness of all the sub-light emitting units are 100%, and the data brightness of the pixel 414 is 15%. Therefore the transmittance of the first liquid crystal element 214 and the transmittance of the second liquid crystal element 314 are set so that a value generated by multiplying the transmittance of the first liquid crystal element 214 by the transmittance of the second liquid crystal element 314 becomes 15%. In this example, the transmittance of the first liquid crystal element 214 is set to 15%, and the transmittance of the second liquid crystal element 314 is set to 100%.

Then the processing in S704 is performed.

The set values of the emission brightness of all the sub-light emitting unit s are 100%, and the power consumption of the backlight unit 100, in a case where the emission brightness of all the sub-light emitting units is 100%, is 50 W.

The set values of the transmittance of 23 first liquid crystal elements 201 to 212 and 215 to 225 are 0%. The power consumption of the first liquid crystal panel 200, in a case where the transmittance of the 23 first liquid crystal elements 201 to 212 and 215 to 225 is controlled to 0%, is 4.6 W (=5 W×(23/25)). The set value of the transmittance of the first liquid crystal element 213 is 100%, and the power consumption of the first liquid crystal panel 200, in a case where the transmittance of the first liquid crystal element 213 is controlled to 100%, is 0.4 W (=10 W×(1/25)). The set value of the transmittance of the first liquid crystal element 214 is 15%, and the power consumption of the first liquid crystal panel 200, in a case where the transmittance of the first liquid crystal element 214 is controlled to 15%, is 0.23 W (=5.75 W×(1/25)). Therefore the total power consumption of the first liquid crystal panel 200, in a case where the values set in S703 are used, is calculated as 5.23 W (=4.6 W+0.4 W+0.23 W).

The set values of the transmittance of the 23 second liquid crystal elements 301 to 312 and 315 to 325 are 0%. The power consumption of the second liquid crystal panel 300, in a case where the transmittance of the 23 second liquid crystal elements 301 to 312 and 315 to 325 is set to 0%, is 4.6 W. The set values of the transmittance of 2 second liquid crystal elements 313 and 314 are 100%, and the power consumption of the second liquid crystal panel 300, in a case where the transmittance of the 2 second liquid crystal elements 313 and 314 is controlled to 100%, is 0.8 W (=10 W×(2/25)). Therefore the total power consumption of the second liquid crystal panel 300, in a case where the values set in S703 are used, is calculated as 5.4 W (=4.6 W+0.8 W).

Then the total power consumption (reference power) of the image display apparatus 10, in a case where the values set in S702 and S703 are used, is calculated as 60.63 W (=50 W+5.23 W+5.4 W).

Then the set values of the emission brightness of the sub-light emitting units, corresponding to the regions of which data brightness is low in the display target image, are reduced based on the display target image data. The data brightness of 8 pixels: 401, 403, 405, 411, 415, 421, 423 and 425 is 0%. Therefore the set values of the emission brightness of 8 sub-light emitting units: 101, 103, 105, 111, 115, 121, 123 and 125, corresponding to these 8 pixels, are adjusted to 0%.

Then the set values of the emission brightness of the sub-light emitting units and the set values of the transmittance of the liquid crystal elements are adjusted so as to suppress the change of the display brightness caused by reducing the emission brightness of the 8 sub-light emitting units from 100% to 0%. In concrete terms, the set values are adjusted for a sub-light emitting unit of which set value of the emission brightness is 100% and a liquid crystal element of which set value of the transmittance is not 0%.

The irradiation brightness of the first liquid crystal element 213, in a case where the emission brightness of all the sub-light emitting units is controlled to 100%, is calculated based on the emission profile of each sub-light emitting element. The irradiation brightness is the brightness of light irradiated from the backlight unit 100 to the first liquid crystal element. The brightness of the light irradiated from the sub-light emitting unit 113 to the first liquid crystal element 213 is 100%. The brightness of light irradiated from 4 sub-light emitting units 103, 111, 115 and 123 to the first liquid crystal element 213 is 80% (=20%×4). The brightness of light irradiated from 4 sub-light emitting units 101, 105, 121 and 125 to the first liquid crystal element 213 is 20% (=5%×4). Therefore the irradiation brightness of the first liquid crystal element 213, in a case where the emission brightness of all the sub-light emitting units is controlled to 100%, is calculated as 200% (=100%+80%+20%). In this example, the 200% irradiation brightness corresponds to the 100% data brightness of the display target image.

In the same manner, the irradiation brightness of the first liquid crystal element 213, in a case where the emission brightness of the sub-light emitting unit 113 is controlled to 100% and the emission brightness of the sub-light emitting units is controlled to 0%, is calculated as 100%.

According to the above calculation result, it is determined that the display brightness of the pixel 413 is reduced to half in a case where the emission brightness of the 8 sub-light emitting units is reduced from 100% to 0%. Then the set value of the emission brightness of the sub-light emitting unit 113 is adjusted to 200% (100%×2).

Then the irradiation brightness of the first liquid crystal element 214, in a case where the emission brightness of the sub-light emitting unit 113 is controlled to 200% and the emission brightness of the 8 sub-light emitting units is controlled to 0%, is calculated as 120% (60%×2). Here the data brightness of the pixel 414 is 15%, hence the transmittance of the first liquid crystal element 214 and the second liquid crystal element 314 must be controlled so that the brightness of the light transmitted through the first liquid crystal element 214 and the second liquid crystal element 314 is controlled to 30% (200% irradiation brightness× 15%). Therefore the set values of the transmittance of the first liquid crystal element 214 and the second liquid crystal element 314 are adjusted so that a value generated by multiplying the above calculation result (120%) by the transmittance of the first liquid crystal element 214 and the transmittance of the second liquid crystal element 314 becomes 30%. In this example, the set value of the transmittance of the first liquid crystal element 214 and the set value of the transmittance of the second liquid crystal element 314 are adjusted to 50% respectively.

If these adjusted set values are used, the power consumption of the backlight unit 100 becomes 11.1 W (=100 W×(1/9)). The power consumption of the first liquid crystal panel 200 becomes 5.3 W (=4.6 W+0.4 W+0.3 W), and the power consumption of the second liquid crystal panel 300 becomes 5.3 W. Therefore the total power consumption of the image display apparatus 10, in a case where the adjusted set values are used, is calculated as 21.7 W (=11.1 W+5.3 W+5.3 W), which is lower than the reference power 60.63 W. As a result, it is determined that the total power consumption can be reduced to a value less than the reference power, and the adjusted set values are used as the final set values. If the total power consumption, in a case where the adjusted set values are used, is the reference power or more, then it is determined that the total power consumption cannot be reduced to a value less than the reference power, and the values set in S702 and S703 are used as the final set values.

The above describes the processing in S704.

Then the set value of the emission brightness of the backlight unit 100, the set value of the transmittance of the first liquid crystal panel 200, and the set value of the transmittance of the second liquid crystal panel 300 are outputted from the determination unit 510 (S705).

By the above processing, the total power consumption of the image display apparatus 10 can be reduced from 60.63 W to 21.7 W, while suppressing the change of the display brightness of the image display apparatus 10.

The control method (determination method) for the emission brightness and the transmittance is not limited to the above method. Any method can be used to control the emission brightness and the transmittance if the total power consumption can be reduced and the change of the display brightness can be suppressed.

An example of the processing flow of the determination unit 510, in a case where the data brightness of the display target image is the data brightness shown in FIG. 12B, will be described. In FIG. 12B, the data brightness of the pixels 413 and 414 is 50%, and the data brightness of the remaining pixels is 0%.

First 50% is detected as the maximum brightness, since the data brightness of the pixels 413 and 414 is 50% and the data brightness of the remaining pixels is 0% (S701).

Then since the maximum brightness is 50%, 50% is set as the emission brightness of all the sub-light emitting units (S702).

Then the processing in S703 is performed.

The set values of the emission brightness of all the sub-light emitting units are 50%, and the data brightness of the pixel 401 is 0%. Therefore the transmittance of the first liquid crystal element 201 and the transmittance of the second liquid crystal element 301 are set to 0%. In the same manner, the transmittance of the first liquid crystal elements 202 to 212 and 215 to 225, and the transmittance of the second liquid crystal elements 302 to 312 and 315 to 325, are set to 0%.

The set values of the emission brightness of all the sub-light emitting units are 50%, and the data brightness of the pixel 413 is 50%. Therefore the transmittance of the first liquid crystal element 213 and the transmittance of the second liquid crystal element 313 are set to 100%. In the same manner, the transmittance of the first liquid crystal element 214 and the transmittance of the second liquid crystal element 314 are set to 100%.

Then the processing in S704 is performed.

The set values of the emission brightness of all the sub-emitting units are 50%, and the power consumption of the backlight unit 100, in a case where the emission brightness of all the sub-light emitting units is 50%, is 25 W.

The set values of the transmittance of the 23 first liquid crystal elements 201 to 212 and 215 to 225 are 0%. The power consumption of the first liquid crystal panel 200, in a case where the transmittance of the 23 first liquid crystal elements 201 to 212 and 215 to 225 is controlled to 0%, is 4.6 W (=5 W×(23/25)). The set values of the transmittance of the 2 first liquid crystal elements 213 and 214 are 100%, and the power consumption of the first liquid crystal panel 200, in a case where the transmittance of the 2 first liquid crystal elements 213 and 214 is controlled to 100%, is 0.8 W (=10 W×(2/25)). Therefore the total power consumption of the first liquid crystal panel 200, in a case where the values set in S703 are used, is calculated as 5.4 W (=4.6 W+0.8 W).

The set values of the transmittance of the 23 second liquid crystal elements 301 to 312 and 315 to 325 are 0%. The power consumption of the second liquid crystal panel 300, in a case where the transmittance of the 23 second liquid crystal elements 301 to 312 and 315 to 325 is controlled to 0%, is 4.6 W. The set values of the transmittance of the 2 second liquid crystal elements 313 and 314 are 100%, and the power consumption of the second liquid crystal panel 300, in a case where the transmittance of the 2 second liquid crystal elements 313 and 314 is controlled to 100%, is 0.8 W. Therefore the total power consumption of the second liquid crystal panel 300, in a case where the values set in S703 are used, is calculated as 5.4 W (=4.6 W+0.8 W).

Then the total power consumption (reference power) of the image display apparatus 10, in a case where the values set in S702 and S703 are used, is calculated as 35.8 W (=25 W+5.4 W+5.4 W).

Then the set values of the emission brightness of the sub-light emitting units, corresponding to the regions of which data brightness is low in the display target image, are reduced based on the display target image data. The data brightness of 8 pixels: 401, 403, 405, 411, 415, 421, 423 and 425 is 0%. Therefore the set values of the emission brightness of 8 sub-light emitting units: 101, 103, 105, 111, 115, 121, 123 and 125, corresponding to these 8 pixels, are adjusted to 0%.

Then the set values of the emission brightness of the sub-light emitting units and the set values of the transmittance of the liquid crystal elements are adjusted so as to suppress the change of the display brightness caused by reducing the emission brightness of the 8 sub-light emitting units from 50% to 0%. In concrete terms, the set values are adjusted for a sub-light emitting unit, of which set value of the emission brightness is 50% and a liquid crystal element of which set value of the transmittance is not 0%.

The irradiation brightness of the first liquid crystal element 213, in a case where the emission brightness of all the sub-light emitting units is controlled to 50%, is calculated as 100%. In the same manner, the irradiation brightness of the first liquid crystal element 213, in a case where the emission brightness of the sub-light emitting unit 113 is controlled to 50% and the emission brightness of the 8 sub-light emitting units is controlled to 0%, is calculated as 50%. According to these calculation results, it is determined that the display brightness of the pixel 413 is reduced to half in a case where the emission brightness of the 8 sub-light emitting units is reduced from 50% to 0%. Then the set value of the emission brightness of the sub-light emitting unit 113 is adjusted to 100% (50%×2).

Then the irradiation brightness of the first liquid crystal element 214, in a case where the emission brightness of the sub-light emitting unit 113 is controlled to 100% and the emission brightness of the 8 sub-light emitting units is controlled to 0%, is calculated as 60%. Here the data brightness of the pixel 414 is 50%, hence the brightness of the light transmitted through the first liquid crystal element 214 and the second liquid crystal element 314 must be controlled to 100% (200% irradiation brightness×50%). However, if the irradiation brightness is 60%, the brightness of the light transmitted through the first liquid crystal element 214 and the second liquid crystal element 314 cannot be controlled to 100%. Therefore the set value of the emission brightness of the sub-light emitting unit 113 is adjusted to 167% (=100%×(100/60)). In a case where the emission brightness of the sub-light emitting element 113 is controlled to 167% and the emission brightness of 8 sub-light emitting units is controlled to 0%, the irradiation brightness of the first liquid crystal element 214 becomes 100%. This means that if the transmittance of the first liquid crystal element 214 and the transmittance of the second liquid crystal element 314 are controlled to 100%, the light, of which brightness is 100%, can be acquired as the light transmitted through the first liquid crystal element 214 and the second liquid crystal element 314.

Then the irradiation brightness of the first liquid crystal element 213, in a case where the emission brightness of the sub-light emitting unit 113 is controlled to 167% and the emission brightness of the 8 sub-light emitting units is controlled to 0%, is calculated as 167%. Here the data brightness of the pixel 413 is 50%, hence the brightness of the light transmitted through the first liquid crystal element 213 and the second liquid crystal element 313 must be controlled so that the brightness of the light transmitted through the first liquid crystal element 213 and the second liquid crystal element 313 is controlled to 100%. Therefore the set values of the transmittance of the first liquid crystal element 213 and the second liquid crystal element 313 are adjusted based on the above calculation result (167%) and the data brightness (50%) of the pixel 413. In concrete terms, the set values of the transmittance of the first liquid crystal element 213 and the second liquid crystal element 313 are adjusted so that a value generated by multiplying the transmittance of the first liquid crystal element 213 by the transmittance of the second liquid crystal element 313 becomes 60% (=100%×(60/100)). In this example, the set value of the transmittance of the first liquid crystal element 213 is adjusted to 80%, and the set value of the transmittance of the second liquid crystal element 313 is adjusted to 75%.

If these adjusted set values are used, the power consumption of the backlight unit 100 becomes 9.26 W (=83.3 W×(1/9)). The power consumption of the first liquid crystal panel 200 becomes 5.36 W (=4.6 W+0.4 W+0.36 W), and the power consumption of the second liquid crystal panel 300 becomes 5.35 W (=4.6 W+0.4 W+0.35 W). Therefore the total power consumption of the image display apparatus 10, in a case where the adjusted set values are used, is calculated as 19.97 W (=9.26 W+5.36 W+5.35 W), which is lower than the 35.8 W reference power. As a result, it is determined that the total power consumption can be reduced to a value less than the reference power, and the adjusted set values are used as the final set values.

The above describes the processing in S704.

Then the set value of the emission brightness of the backlight unit 100, the set value of the transmittance of the first liquid crystal panel 200, and the set value of the transmittance of the second liquid crystal panel 300 are outputted from the determination unit 510 (S705).

By the above processing, the total power consumption of the image display apparatus 10 can be reduced from 35.8 W to 19.97 W, while suppressing the change of the display brightness of the image display apparatus 10.

As described above, according to this example, the emission brightness of each sub-light emitting unit is controlled independently. Thereby the total power consumption of the image display apparatus having 2 transmission panels (liquid crystal panels) can be further reduced. Moreover, according to this example, the emission brightness of each sub-light emitting unit, the transmittance of the first liquid crystal panel, and the transmittance of the second liquid crystal panel, are controlled additionally considering the diffusion of light emitted from each sub-light emitting unit. Thereby the change of the display brightness can be further suppressed.

In Embodiments 1 and 2, examples of using three power information (first power information, second power information and third power information) were described, but [the present invention] is not limited to this. All that is required is that the emission brightness of the backlight unit and at least one of the transmittance of the first liquid crystal panel and the transmittance of the second liquid crystal panel can be controlled (adjusted) based on the first power information, and at least one of the second power information and the third power information. For example, the emission brightness of the backlight unit and the transmittance of the first liquid crystal panel may be controlled based on the first power information and the second power information. In this case, the transmittance of the second liquid crystal panel can be controlled to a predetermined value, or can be controlled by a predetermined method where power information is not used. Further, the emission brightness of the backlight unit and the transmittance of the second liquid crystal panel may be controlled based on the first power information and the third power information. In this case, the transmittance of the first liquid crystal panel can be controlled to a predetermined value, or can be controlled by a predetermined method where power information is not used. All that is required for the storage unit is storing at least the power information to be used. In other words, it is sufficient if the storage unit stores the first power information and at least one of the second power information and the third power information. If the configuration of the first liquid crystal panel is the same as the configuration of the second liquid crystal panel, one power information combining the second power information and the third power information may be provided.

It may not be necessary for power information (first power information, second power information, third power information) to be used. All that is required is that the emission brightness of the backlight unit and at least one of the transmittance of the first liquid crystal panel and the transmittance of the second liquid crystal panel are controlled based on the display target image data. In the case of a configuration where the power information is not used, if the brightness of the image data is low, for example, the emission brightness of the backlight unit is controlled to a lower emission brightness compared with the case where the brightness of the image data is high. Then at least one of the transmittance of the first liquid crystal panel and the transmittance of the second liquid crystal panel is controlled based on the emission brightness of the backlight unit and the display target image data, so that the image is displayed based on the display target image data. According to this configuration, an effect of reducing total power consumption of the image display apparatus to a level lower than the case of fixing the emission brightness of the backlight unit can be expected.

The effect of reducing the total power consumption of the image display apparatus without using the power information will be described with reference to FIGS. 13A to 13C. FIG. 13A show an example of the display target image (display target image data). FIG. 13B shows an example in a case where the emission brightness of the backlight unit is fixed, and only the transmittance of the first liquid crystal panel and the transmittance of the second liquid crystal panel are controlled based on the display target image data. FIG. 13C shows an example in a case where the emission brightness of the backlight unit, the transmittance of the first liquid crystal panel and the transmittance of the second liquid crystal panel are controlled based on the display target image data. In FIGS. 13A to 13C, for simplification, each of the display target image, the first liquid crystal panel, the second liquid crystal panel, the backlight unit and the display image (image displayed on screen) is divided into a total of 25 (5 horizontal×5 vertical).

In FIG. 13A, a numerical value written in each region of the display target image indicates the brightness of the display target image in the region. In FIG. 13A, the brightness in the region on the third row—third column is 100%, and the brightness of the remaining 24 regions is 0%. In FIGS. 13B and 13C, the numerical value written in each region of the first liquid crystal panel is the transmittance of the first liquid crystal panel in the region. The numerical value written in each region of the second liquid crystal panel is the transmittance of the second liquid crystal panel in the region. The numerical value written in each region of the backlight unit is the emission brightness of the backlight unit in the region. The numerical value written in each region of the display image is the brightness of the display image in the region. The numerical values written in FIGS. 13B and 13C are values in the case where the display target image in FIG. 13A is used.

In FIG. 13B, the transmittance of the first liquid crystal panel in the region on the third row—third column is 100%, and the transmittance of the first liquid crystal panel in the remaining 24 regions is 0%. The transmittance of the second liquid crystal panel in the region on the third row—third column is 100%, and the transmittance of the second liquid crystal panel in the remaining 24 regions is 0%. The emission brightness of the backlight unit in all the regions is 100%. Thereby a display image having substantially a same brightness as the display target image can be acquired.

Here it is assumed that power required for controlling the transmittance of the liquid crystal panels (first liquid crystal panel, second liquid crystal panel) in one region to 0% is 1 mW, and power required for controlling the transmittance of the liquid crystal panels in one region to 100% is 100 mW. Then in FIG. 13B, the power consumption of the first liquid crystal panel and the power consumption of the second liquid crystal panel become 124 mW respectively. It is also assumed that power required for controlling the emission brightness of the backlight unit in one region to 0% is 0 W, and power required for controlling the emission brightness of the backlight unit in one region to 100% is 1 W. Then in FIG. 13B, the power consumption of the backlight unit becomes 25 W. As a result, in FIG. 13B, the total power consumption of the image display apparatus becomes 25.248 W.

In FIG. 13C, the transmittance of the first liquid crystal panel in all the regions is 100%, and the transmittance of the second liquid crystal panel in all the regions is 100%. The emission brightness of the backlight unit in the region on the third row—third column is 100%, and the emission brightness of the backlight unit in the remaining 24 regions is 0%. Thereby a display image having substantially the same brightness as the display target image can be acquired.

As mentioned above, power required for controlling the transmittance of the liquid crystal panels in one region to 0% is 1 mW, and power required for controlling the transmittance of the liquid crystal panels in one region to 100% is 100 mW. Therefore in FIG. 13C, the power consumption of the first liquid crystal panel and the power consumption of the second liquid crystal panel become 2.5 W respectively. Further, power required for controlling the emission brightness of the backlight unit in one region to 0% is 0 W, and power required for controlling the emission brightness of the backlight unit in one region to 100% is 1 W. Therefore in FIG. 13C, the power consumption of the backlight unit is 1 W. As a result, in FIG. 13C the total power consumption of the image display apparatus is 6 W, which is lower than the total power consumption in FIG. 13B by 19.248 W.

Thus the total power consumption of the image display apparatus can be reduced by controlling the emission brightness of the backlight unit, and at least one of the transmittance of the first liquid crystal panel and the transmittance of the second liquid crystal panel based on the display target image data. In concrete terms, the total power consumption of the image display apparatus can be reduced to a value that is lower than the case of fixing the emission brightness of the backlight unit.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-243300, filed on Dec. 1, 2014, and Japanese Patent Application No. 2015-222249, filed on Nov. 12, 2015, which are hereby incorporated by reference herein in its entirety.

What is claimed is:

1. An image display apparatus, comprising:

a light emitter;

a first panel configured to transmit light emitted from the light emitter;

a second panel configured to transmit the light transmitted through the first panel; and a controller configured to control, based on image data, emission brightness of the light emitter, transmittance of the first panel, and transmittance of the second panel, so that an image based on the image data is displayed on the second panel, wherein the controller selects one, under which power consumption of the image display apparatus is lower, of a first control condition and a second control condition, based on a first power consumption of the image display apparatus in a case of displaying the image using the first control condition and a second power consumption of the image display apparatus in a case of displaying the image using the second control condition, each of the first control condition and the second control condition being a control condition for controlling the light emitted from the light emitter, the emission brightness of the light emitter under the first control condition being higher than the emission brightness of the light emitter under the second control condition, controls the emission brightness of the light emitter with the selected control condition, and controls the transmittance of the first panel and the transmittance of the second panel, in a case where the second control condition is selected, so that a display brightness of the image display apparatus substantially equals a display brightness of the image display apparatus in a case where the first control condition is selected.

2. The image display apparatus according to claim 1, further comprising:

a storage configured to store first power information representing correspondence between the emission brightness of the light emitter and power consumption of the light emitter, second power information representing correspondence between the transmittance of the first panel and power consumption of the first panel, and third power information representing correspondence between the transmittance of the second panel and power consumption of the second panel, wherein the controller further calculates the first power consumption and the second power consumption based on the first power information, the second power information, the third power information, and the image data.

3. The image display apparatus according to claim 1, further comprising:

a detector configured to detect a bright point region having a brightness higher than that in an adjacent region by a first threshold or more and having a size of a second threshold or less, in a region of the image based on the image data, wherein in a case where the first control condition is selected, the controller controls the emission brightness of the light emitter based on image data in which the bright point region is not included, and in a case where the second control condition is selected, the controller controls the emission brightness of the light emitter based on image data in which the bright point region is included.

4. The image display apparatus according to claim 1, wherein in a case where the second control condition is selected, the controller controls the emission brightness of the light emitter by using a drive signal which is lower than a drive signal used for driving the light emitter in a case where the first control condition is selected.

5. The image display apparatus according to claim 1, wherein the light emitter comprises a plurality of light sources of which emission colors are different from one another, and the controller controls emission brightness of each of the plurality of light sources so that an emission color of the light emitter becomes closer to a color of an image represented by the image data.

6. The image display apparatus according to claim 1, wherein the light emitter comprises a first light emitter and a second light emitter, the second light emitter emitting light at a same power consumption as a power consumption of the first light emitter and at a higher emission brightness than an emission brightness of the first light emitter, and in a case where the second control condition is selected, the controller controls the emission brightness of the light emitter by controlling the emission brightness of the first light emitter and the emission brightness of the second light emitter, so that the first light emitter emits light with emission brightness that is lower than emission brightness of the first light emitter in a case where the first control condition is selected.

7. The image display apparatus according to claim 1, wherein in a case where the first control condition is selected, the controller controls the emission brightness of the light emitter to be a predetermined emission brightness, and in a case where the second control condition is selected, the controller controls the emission brightness of the light emitter to an emission brightness according to the image data.

8. The image display apparatus according to claim 1, wherein the light emitter comprises a plurality of sub-light emitters, in a case where the first control condition is selected, the controller controls emission brightness of each of the plurality of sub-light emitters to be a predetermined brightness, and in the case where the second control condition is selected, for each of the plurality of sub-light emitters, the controller controls the emission brightness of the sub-light emitter to an emission brightness according to a brightness of a part of the image data that corresponds to the respective sub-light emitter.

9. A method for controlling an image display apparatus having:

a light emitter;

a first panel configured to transmit light emitted from the light emitter; and a second panel configured to transmit the light transmitted through the first panel, the method comprising:

acquiring image data; and controlling, based on the image data, emission brightness of the light emitter, transmittance of the first panel, and transmittance of the second panel, so that an image based on the image data is displayed on the second panel, wherein, in the controlling, one, under which power consumption of the image display apparatus is lower, of a first control condition and a second control condition is selected based on a first power consumption of the image display apparatus in a case of displaying the image using the first control condition and a second power consumption of the image display apparatus in a case of displaying the image using the second control condition, each of the first control condition and the second control condition being a control condition for controlling the light emitted from the light emitter, and the emission brightness of the light emitter under the first control condition being higher than the emission brightness of the light emitter under the second control condition, the emission brightness of the light emitter is controlled with the selected control condition, and in a case where the second control condition is selected, the transmittance of the first panel and the transmittance of the second panel are controlled so that a display brightness of the image display apparatus substantially equals a display brightness of the image display apparatus in a case where the first control condition is selected.

10. A non-transitory computer readable medium that stores a program, wherein the program causes a computer to execute a method for controlling an image display apparatus having:

a light emitter;

a first panel configured to transmit light emitted from the light emitter; and a second panel configured to transmit the light transmitted through the first panel, the method comprising:

acquiring image data; and controlling, based on the image data, emission brightness of the light emitter, transmittance of the first panel, and transmittance of the second panel, so that an image based on the image data is displayed on the second panel, wherein, in the controlling, one, under which power consumption of the image display apparatus is lower, of a first control condition and a second control condition is selected based on a first power consumption of the image display apparatus in a case of displaying the image using the first control condition and a second power consumption of the image display apparatus in a case of displaying the image using the second control condition, each of the first control condition and the second control condition being a control condition for controlling the light emitted from the light emitter, and the emission brightness of the light emitter under the first control condition being higher than the emission brightness of the light emitter under the second control condition, the emission brightness of the light emitter is controlled with the selected control condition, and in a case where the second control condition is selected, the transmittance of the first panel and the transmittance of the second panel are controlled so that a display brightness of the image display apparatus substantially equals a display brightness of the image display apparatus in a case where the first control condition is selected.

11. The image display apparatus according to claim 7, wherein in the case where the second control condition is selected, the controller controls the emission brightness of the light emitter to an emission brightness according to a maximum brightness of the image data.

12. The image display apparatus according to claim 8, wherein in the case where the second control condition is selected, for each of the plurality of sub-light emitters, the controller controls the emission brightness of the sub-light emitter to an emission brightness according to a maximum brightness of a part of the image data that corresponds to the respective sub-light emitter.

* * * * *